US006319022B1

(12) United States Patent
Hwang

(10) Patent No.: US 6,319,022 B1
(45) Date of Patent: Nov. 20, 2001

(54) ELECTRICAL CONNECTOR WITH WARPAGE-DETENTION DEVICE

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/599,065

(22) Filed: Jun. 21, 2000

(51) Int. Cl.[7] ..... H01R 12/20
(52) U.S. Cl. ..... 439/79
(58) Field of Search ..... 439/79, 567, 571, 439/572

(56) References Cited

U.S. PATENT DOCUMENTS 5,591,036 * 1/1997 Doi et al. ..... 439/79
5,658,154 * 8/1997 Bumsted et al. ..... 439/79
5,876,222 * 3/1999 Gardner et al. ..... 439/79
5,980,272 * 11/1999 McHugh et al. ..... 439/79

* cited by examiner

*Primary Examiner*—Gary Paumen
(74) *Attorney, Agent, or Firm*—Wei Te Chung

(57) ABSTRACT

An electrical connector comprises a dielectric elongate housing defining upper and lower faces. A plurality of discrete mating portions is spaced along the upper face of the housing. Each mating portion includes a plurality of passageways extending between the upper and lower faces. A plurality of terminals is received in the passageways. Each terminal includes a mating portion accessible in the mating portion, and a tail portion extending beyond the lower face of the housing. Warpage detention device formed in the housing includes a standoff formed on the lower face of the housing, and locking devices extending downward from opposite ends of the housing.

1 Claim, 3 Drawing Sheets

ELECTRICAL CONNECTOR WITH WARPAGE-DETENTION DEVICE

FIELD OF THE INVENTION

The present invention relates to an electrical connector, and more particularly to an elongate electrical connector with warpage-detention device such that the coplanarity of terminal tails thereof can be ensured.

DESCRIPTION OF THE PRIOR ART

Warpage or banana effect of a housing is inevitable during making an elongate connector. Warpage of the connector will damage coplanarity of terminal tails, especially for the terminal tails are soldered to the printed circuit board through surface mount technology.

U.S. Pat. No. 5,658,154 issued to Bumsted et al on Aug. 19, 1997 discloses the use of a recess 40 and a rib 50 to overcome the warpage of the housing. Providing the ribs 50 and recesses 50 does reduce the warpage of the housing, however, when the connector is vertically attached to the printed circuit board, there is limited space to provide the ribs under the housing, especially the terminal tails extend therefrom.

In addition, because of the property of the plastic housing, it seems to be impossible to completely eliminate the warpage of the housing of the elongate connector. Accordingly, it would be more practical to provide a device which can effectively reduce the warpage of the housing when attaching the connector to the printed circuit board, while ensure coplanarity of the terminal tails.

SUMMARY OF THE INVENTION

It is an objective of this invention to provide an electrical connector with warpage-detention device such that the coplanarity of terminal tails thereof can be ensured.

In order to achieve the objective set forth, an electrical connector in accordance with the present invention comprises a dielectric elongate housing defining upper and lower faces. A plurality of discrete mating portions is spaced along the upper face of the housing. Each mating portion includes a plurality of passageways extending between the upper and lower faces. A plurality of terminals is received in the passageways. Each terminal includes a mating portion accessible in the mating portion, and a tail portion extending beyond the lower face of the housing. Warpage detention means formed in the housing includes a standoff formed on the lower face of the housing, and locking devices extending downward from opposite ends of the housing.

According to one aspect of the present invention, wherein the standoff includes a pair of wings extending from the housing.

These and additional objects, features, and advantages of the present invention will become apparent after reading the following detailed description of the preferred embodiment of the invention taken in conjunction with the appended drawings.

DETAILED DESCRIPTION OF THE PREFERRED EMBODIMENT

Figure 1:
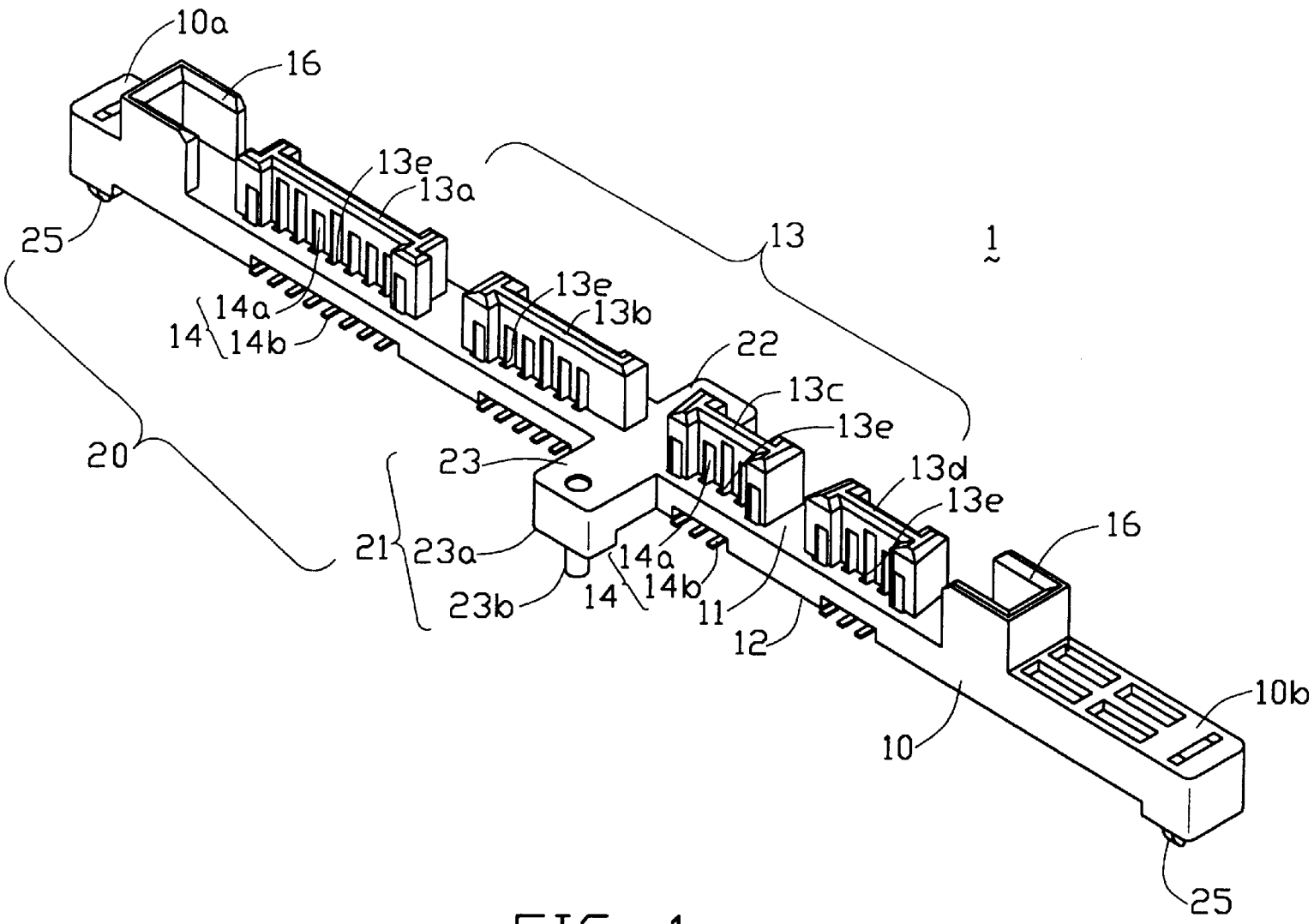
FIG. 1 is a perspective view of an electrical connector in accordance with the present invention.
Figure 2:
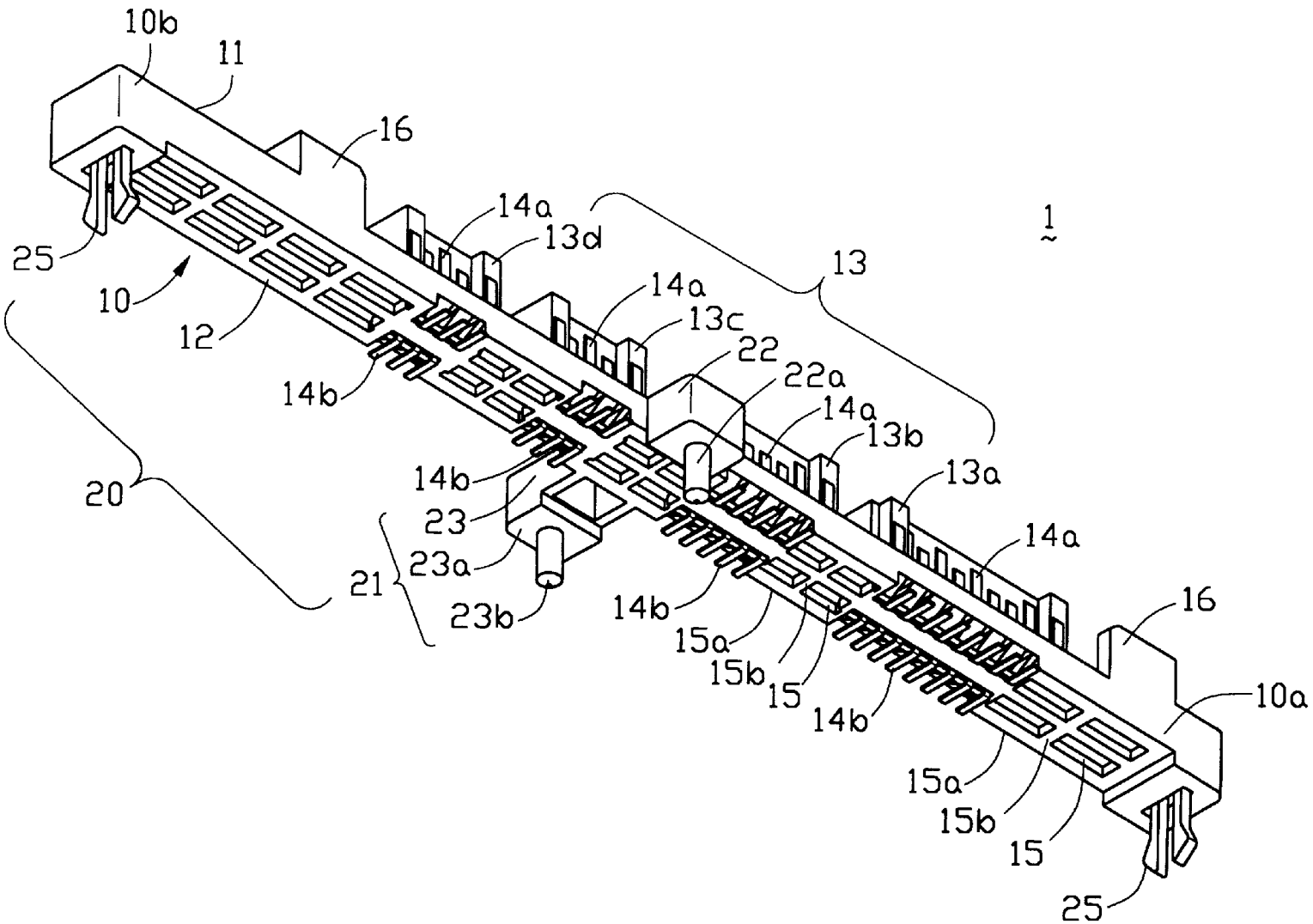
FIG. 2 is a still a perspective view of the electrical connector viewed from a reverse direction.

Referring to FIGS. 1 and 2, an electrical connector 1 in accordance with the present invention comprises a dielectric elongate housing 10 defining upper and lower faces 11, 12. A plurality of discrete mating portions 13, i.e. 13*a*, 13*b*, 13*c* and 13*d*, is spaced along the upper face 11 of the housing 10. Each mating portion 13 includes a plurality of passageways 13*a* extending between the upper and lower faces 11, 12. A plurality of terminals 14 is received in the passageways 11*a*. Each terminal 14 includes a mating portion 14*a* accessible in the mating portion 11, and a tail portion 14*b* extending beyond the lower face 12 of the housing 10. In the preferred embodiment, the terminal tails 14*b* are arranged for SMT to a printed circuit board 30.

Since all the mating portions 13 are located in the upper face 11 of the housing 10, ends 10*a*, 10*b* of the housing 10 tends to be lifted upward because of the warpage. As a result, terminal tails 14*b* of the mating portions 13*a* and 13*d* will be lifted upward thereby the terminal tails of the mating portions 13*a*, 13*b*, 13*c* and 13*d* are not coplanar. This will cause a great problem when soldering the terminal tails 14*b* to a printed circuit board In order to reduce the warpage, a plurality of lattice-like structures are defined in the lower face 12 of the housing 10, and are not aligned with any of the mating portions 13*a*, 13*b*, 13*c* and 13*d* in a front-to-back direction. Each lattice-like structure includes matrix type downward facing openings each surrounded by bars 15*a* and 15*b*. The housing 10 further includes a pair of guiding racks 16 for guiding a mating connector (not shown) during insertion.

Figure 3:
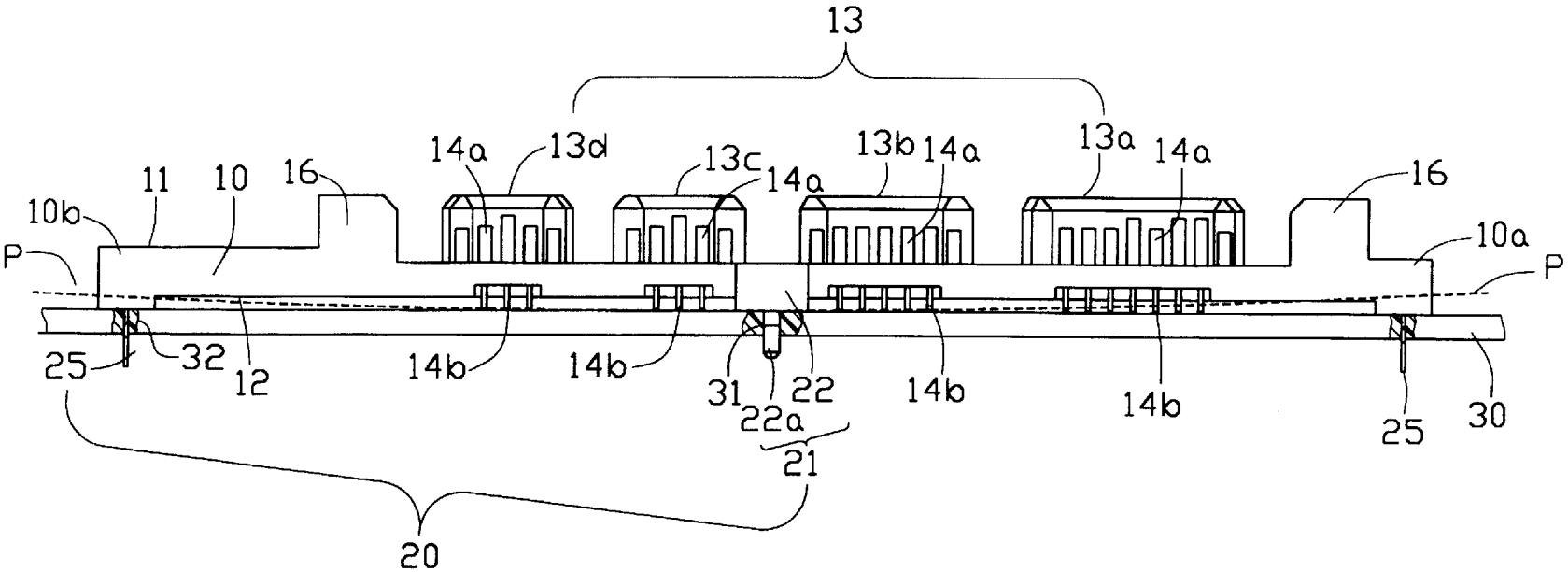
FIG. 3 is a front view of the electrical connector assembled to a printed circuit board.

As shown in FIG. 3, the phantom line (P) is used to show the warpage of the connector 1 after molding. When the connector 1 is inherited with a warpage, both the ends 10*a*, 10*b* are away from a printed circuit board on which the connector 1 is assembled. This will definitely and negatively affect on the coplanarity of the terminal tails 14*b*.

Since the warpage of the housing 10 can never completely eliminated, it is practical to introduce devices or means to reduce the warpage of the housing 10, while ensure the coplanarity of the terminal tails 14*b*.

According to the preferred embodiment of the present invention, warpage detention means 20 is integrally formed on the housing 10 of the connector 1. The warpage detention means 20 includes a standoff 21 integrally formed with the housing 10, and a pair of boardlocks extending from opposite ends 10*a*, 10*b* of the housing 10.

The standoff 21 includes a supporting block 22 and a wing 23 extending opposite to the supporting block 22. The wing 23 further includes a pad 23*a* extending downward. According to the preferred embodiment, the height of the standoff 21, measured from the lower face 11 of the housing 10, is a little bit shorter than the height of the terminal tails 14*b* extending beyond the lower face 14*b* of the housing 10. This arrangement will ensure the connections between the terminal tails 14*b* and the printed circuit board 30.

In the present invention, the standoff 21 is located between the mating portions 11*b* and 11*c*, and which is closer to the center of warpage. Accordingly, when the boardlocks 25 are fixedly retained to holes 31 of the printed circuit board 30, both ends 10*a*, 10*b* of the housing 10 is pulled and pivoted downward centered on the standoff 21. In addition, as the standoff 21 is a little bit short to the terminal tails 14*b*, the standoff 21 will be in firm contact with the printed circuit board 30 to prevent the terminal tails 14*b* from further being depressed down by the downward movement of the housing 10 resulted from pivotal movement of the ends 10*a*, 10*b* of the housing 10 as the boardlocks 25 are retained to the holes 31 of the printed circuit board 30.

The providing of the boardlocks 25 to the housing 10 is essential to the coplanarity of the terminal tails 14*b*. When the boardlocks 25 are fixedly retained in the holes 31 of the printed circuit board 30, both ends 10*a*, 10*b* of the housing 10 are pressed downward such that the warpage line (P) is eliminated, i.e. the terminal tails 14*b* are coplanar in the same plane of the printed circuit board 30.

In addition, the standoff 21 plays an essential role also. If there is no standoff 21, the terminal tails 14*b* of the mating portion 13*b*, 13*c* will be exerted more downward force as compared to terminal tails 14*b* of the mating portions 13*a*, 13*d* when the ends 10*a*, 10*b* are pulled down by the boardlocks 25. However, by the provision of the standoff 21, over-pressure to the terminal tails 14*b* are completely shifted to the standoff 21 which is more rigid. As a result, the terminal tails 14*b* of the mating portions 13*b* and 13*c* are well protected and will not be damaged by over-pressure. Not only the provision of the standoff 21 will help to eliminate the warpage of the housing 10 in corporation with the boardlocks 25, but will also protect the terminal tails 14*b* of the mating portions 13*b*, 13*c* from being over-stressed. The problem of the warpage encountered in the elongate connector 1 is therefore completely solved.

In addition, the standoff 21 further includes guiding posts 22*a*, 23*b* extending downward from the supporting block 22 and the pad 23*a*. The guiding posts 22*a*, 23*b* can be correctly received in corresponding holes 32 of the printed circuit board 30, thereby ensuring correction mounting of the connector 1 to the printed circuit board 30.

Figure 4:
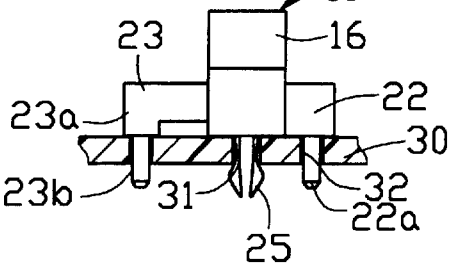
FIG. 4 is a side view of FIG. 3.

As clearly shown in FIG. 4, since the supporting block 22 and the wing 23 extend transversely from the housing 10, the bottom area of the housing 10 is therefore increased. This is advantageous when a mating connector is mated to the connector 1 from a vertical direction. As a result, rolling movement of the connector 1 resulted from incorrect mating direction can be further sustained.

It can be understood that once the housing 10 of the connector 1 is mounted upon the printed circuit board 30, such matrix type openings 15 are generally covered by the printed circuit board 30 and hidden from exposure to an exterior, thus preventing the risks of improper material, e.g., chips or dust, accumulated within the openings 15 and its associated possible malfunction of the connector 1. The mutually intersecting bars 15*a*, 15*b* of the lattice-like structure may provide reinforcement around the openings 15. Under this situation, the openings can reduce the warpage of the housing 10 while still maintaining the required strength of the housing 10 and preventing invasion of the external improper material into the openings 15.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector, comprising:

a dielectric elongate housing defining upper and lower faces;

a plurality of discrete mating portions spaced along said upper face of said housing, each mating portion including a plurality of passageways extending between said upper and lower faces;

a plurality of terminals received in said passageways, each terminal including a mating section accessible in said mating portion, and a tail portion extending beyond said lower face of said housing; and warpage detention means formed on said housing, including a standoff integrally formed on said lower face of said housing, and locking devices extending downwardly from opposite ends of said housing;

wherein said locking devices are a pair of boardlocks extending from opposite ends of said housing;

wherein said standoff includes a supporting block and a wing extending opposite to said supporting block;

wherein said standoff further includes guiding posts extending downwardly from said supporting block and a pad of said wing;

wherein a plurality of recesses defined in said lower face of said housing thereby decrease warpage along said elongate housing;

wherein said standoff is located in a center of the warpage detention means along said elongate housing;

wherein a height of said standoff is shorter than a height of said tails of said terminals measured from said lower face of said housing.

* * * * *